US007810467B2

(12) United States Patent
Ono et al.

(10) Patent No.: US 7,810,467 B2
(45) Date of Patent: Oct. 12, 2010

(54) OIL SUPPLYING APPARATUS FOR ENGINE

(75) Inventors: Hisashi Ono, Aichi-Ken (JP); Koji Nunami, Gifu-Ken (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 12/538,928

(22) Filed: Aug. 11, 2009

(65) Prior Publication Data

US 2009/0293834 A1 Dec. 3, 2009

Related U.S. Application Data

(62) Division of application No. 11/935,504, filed on Nov. 6, 2007, now Pat. No. 7,588,011.

(30) Foreign Application Priority Data

Nov. 7, 2006 (JP) ..... 2006-301987

(51) Int. Cl.
*F01M 1/02* (2006.01)

(52) U.S. Cl. ..... 123/196 R; 417/310; 417/282

(58) Field of Classification Search ..... 123/196 R, 123/198 C; 417/310, 282, 283, 299
See application file for complete search history.

(56) References Cited

U.S. PATENT DOCUMENTS 5,338,161 A 8/1994 Eley
5,547,349 A 8/1996 Kimura et al.
5,738,501 A 4/1998 Eisenmann et al.
5,797,732 A 8/1998 Watanabe et al.
6,086,337 A 7/2000 Watanabe et al.
6,168,391 B1 1/2001 Ono et al.
6,296,456 B1 10/2001 Thornelow et al.
6,616,419 B2 9/2003 Watanabe et al.

(Continued)

FOREIGN PATENT DOCUMENTS

EP 0 875 678 A2 11/1998

(Continued)

OTHER PUBLICATIONS

Search Report issued Mar. 25, 2010 by the European Patent Office in European Patent Application No. 07020711.3.

*Primary Examiner*—Michael Cuff
*Assistant Examiner*—Hung Q Nguyen
(74) *Attorney, Agent, or Firm*—Buchanan Ingersoll & Rooney PC

(57) ABSTRACT

An oil supplying apparatus includes a first oil path supplying working oil from an outlet port to a portion to be supplied with the working oil, a second oil path supplying the working oil to an oil pressure control valve, a relief oil path, and a valve body oil path. Depending on first, second, third, and fourth ranges of the oil pressure of the working oil in the first oil path, the working oil is supplied to the first oil path, is supplied to the first oil path and to the relief oil path via the valve body oil path, is directly supplied to the first oil path and is supplied to merge into the first oil path via the oil pressure control valve, and is supplied to the first oil path and to the relief oil path via the oil pressure control valve respectively.

1 Claim, 7 Drawing Sheets

U.S. PATENT DOCUMENTS

| | | | |
|---|---|---|---|
| 6,709,242 | B2 | 3/2004 | Watanabe et al. |
| 6,763,797 | B1 | 7/2004 | Staley et al. |
| 7,011,069 | B2 | 3/2006 | Ono et al. |
| 7,281,906 | B2 | 10/2007 | Tanikawa et al. |
| 2005/0098385 | A1 | 5/2005 | Ono et al. |

FOREIGN PATENT DOCUMENTS

| | | | |
|---|---|---|---|
| EP | 1 686 265 | A2 | 8/2006 |
| JP | 2005-140022 | A | 6/2005 |

OIL SUPPLYING APPARATUS FOR ENGINE

CROSS REFERENCE TO RELATED APPLICATIONS

This application is a divisional of U.S. patent application Ser. No. 11/935,504 filed Nov. 6, 3007, which application claims priority under 35 U.S.C. §119 Japanese Patent Application No. 2006-301987 filed on Nov. 7, 2006, both of which are incorporated herein by reference in their entirety.

FIELD OF THE INVENTION

The present invention relates to an oil supplying apparatus.

BACKGROUND OF THE INVENTION

Known oil supplying apparatuses for automobiles, which feed working oil applied for lubricating an engine to each portion in the engine, are configured to have a structure by which output volume of the working oil is variable and which appropriately regulates discharge pressure of the working oil in response to a rotation speed of the engine.

For example, a known oil supplying apparatus described in Japanese Patent JP2005-140022A, which is hereby incorporated by reference herein in its entirety. The oil supplying apparatus described JP2005-140022A includes an inlet port which sucks working oil in response to a rotation of a rotor driving synchronously with a crankshaft, a first outlet port and a second outlet port which discharge the working oil in response to the rotation of the rotor. The oil supplying apparatus further includes a first oil path which feeds the working oil at least from the first outlet port to a portion to be supplied with working oil, a second oil path which feeds the working oil from the second outlet port to the first oil path, and a relief oil path which returns the working oil from a hydraulic pressure control valve, which includes a valve body operating in response to a hydraulic pressure of the working oil in the first oil path, to at least one of the inlet port and an oil pan.

With the construction of the known oil supplying apparatus described in JP2005-140022A, the valve body includes a first valve chamber and a second valve chamber. When the level of the hydraulic pressure of the working oil in the first oil path is within a predetermined range, the working oil from the second outlet port is supplied to the first oil path via the first valve chamber. And the working oil from the second outlet port is supplied to the first oil path via second valve chamber when the oil pressure of the working oil in the first oil path is greater than the predetermined range.

When the hydraulic pressure of the working oil in the first oil path is within the predetermined range and the oil supplying apparatus is structured so that the working oil from the second outlet port is supplied to the first oil path via the first valve chamber, the volume of supplied working oil to the first oil path, in this case, is a total of the output volume from the first outlet port and the output volume from the second outlet port.

In the case where the required level of the hydraulic pressure is ensured only by the working oil from the first outlet port because of an increase of a rotation speed of the rotor and a rotation speed of an internal combustion engine, it is not necessary to merge the working oil from the first oil path and the working oil from the second oil path. In those circumstances, the excessive working oil in the second oil path is returned to the relief oil path without being supplied to the first oil path.

On the other hand, when a rotation speed of the rotor is within a high-speed range, a supply of the large volume of the working oil may be required depending on types of a portion to be supplied with the working oil. Therefore, according to the known oil supplying apparatus described in JP2005-140022A, when the hydraulic pressure of the working oil to the first oil path is greater than the predetermined range, the working oil from the second outlet port is supplied to the first oil path via the second valve chamber. In those circumstances, even after the working oil is assumed to be supplied to the first oil path only from the first outlet port once, a total of the output volume of the working oil from the first outlet port and the working oil of the output volume of the second outlet port is re-supplied to the first oil path.

Accordingly, with the construction of the known oil supplying apparatus described in JP2005-140022A, because the volume of the working oil to be supplied can be increased even when the rotation speed of the rotor is within the high-speed range, necessary oil volume to be supplied to the portion to be supplied with the working oil is securely ensured.

Meanwhile, with the construction of the known oil supplying apparatus described in JP2005-140022A, the total volume of the working oil from the second outlet port flows into the first outlet port via the first valve chamber and the second valve chamber of the valve body provided at the oil pressure control valve. In this case, in order to reduce pressure loss, dimensions of the valve body and the oil pressure control valve are increased. However, when mounting the oil supplying apparatus on the engine, it is preferable to downsize the oil supplying apparatus.

A need thus exists for an oil supplying apparatus for an engine which is not susceptible to the drawbacks mentioned above.

SUMMARY OF THE INVENTION

In light of the foregoing, the present invention provides an oil supplying apparatus for an engine, which includes a pump body including an inlet port sucking working oil in response to a rotation of a rotor driven synchronously with a crankshaft and an outlet port discharging the working oil in response to the rotation of the rotor, a first oil path connected to the outlet port and supplying the working oil from the outlet port to a portion to be supplied with the working oil, an oil pressure control valve connected to the first oil path via an intermediate oil path and operating in response to an oil pressure of the working oil in the first oil path, a second oil path connected to the outlet port at an upstream side relative to a connecting portion between the outlet port and the first oil path and supplying the working oil from the outlet port to the oil pressure control valve, a relief oil path returning the working oil of the oil pressure control valve to at least one of the inlet port and an oil pan, and a valve body oil path provided at a valve body of the oil pressure control valve. The second oil path and the relief oil path are closed by the valve body of the oil pressure control valve when oil pressure of the working oil in the first oil path is within a first pressure range so that the working oil from the outlet port is supplied to the first oil path. The working oil from the outlet port is supplied to the first oil path and is supplied to the relief oil path via the second oil path and the valve body oil path of the oil pressure control valve when oil pressure of the working oil in the first oil path is within a second pressure range which is greater than the first pressure range. The relief oil path is closed by the valve body of the oil pressure control valve, the working oil from the outlet port is directly supplied to the first oil path and is supplied to merge into the first oil path via the second oil path, the oil pressure control valve, and the intermediate oil path when oil pressure of the working oil in the first oil path is within a third pressure range which is greater than the second pressure range. And, the working oil from the outlet port is supplied to the first oil path and is supplied to the relief oil path by establishing communication between the second oil path, the intermediate oil path, and the relief oil path at the oil pressure control valve when oil pressure of the working oil in the first oil path is within a fourth pressure range which is greater than the third pressure range.

According to another aspect of the present invention, an oil supplying apparatus for an engine includes a pump body including an inlet port sucking working oil in response to a rotation of a rotor driven synchronously with a crankshaft and an outlet port discharging the working oil in response to the rotation of the rotor, a first oil path connected to the outlet port and supplying the working oil from the outlet port to a portion to be supplied with the working oil, an oil pressure control valve connected to the first oil path via an intermediate oil path and operating in response to an oil pressure of the working oil in the first oil path, a second oil path connected to the outlet port at an upstream side relative to a connecting portion between the outlet port and the first oil path and supplying the working oil from the outlet port to the oil pressure control valve, a relief oil path connecting a first connecting path and a second connecting path to the oil pressure control valve and returning the working oil of the oil pressure control valve to at least one of the inlet port and an oil pan, and a valve body oil path provided at a valve body of the oil pressure control valve. The second oil path and the relief oil path are closed by the valve body of the oil pressure control valve when oil pressure of the working oil in the first oil path is within a first pressure range so that the working oil from the outlet port is supplied to the first oil path. The working oil from the outlet port is supplied to the first oil path and is supplied to the relief oil path via the second oil path, the valve body oil path of the oil pressure control valve, and the first connecting path when the oil pressure of the working oil in the first oil path is within a second pressure range which is greater than the first pressure range. The second oil path and the relief oil path are closed by the valve body of the oil pressure control valve and the working oil from the outlet port is supplied to the first oil path when the oil pressure of the working oil in the first oil path is within a third pressure range which is greater than the second pressure range. And, the working oil from the outlet port is supplied to the first oil path and is supplied to the relief oil path via the second connecting path by closing the second oil path and the first connecting path by the valve body of the oil pressure control valve and by establishing the communication between the intermediate oil path and the relief oil path at the oil pressure control valve when the oil pressure of the working oil in the first oil path is within a fourth pressure range which is greater than the third pressure range.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION OF THE INVENTION

Embodiments of the present invention will be explained with reference to illustrations of drawing figures as follows. An oil supplying apparatus for an engine, which is mounted on a vehicle and generates oil pressure in response to a rotation of a crankshaft of an internal combustion engine, is explained in the embodiments.

Figure 1:
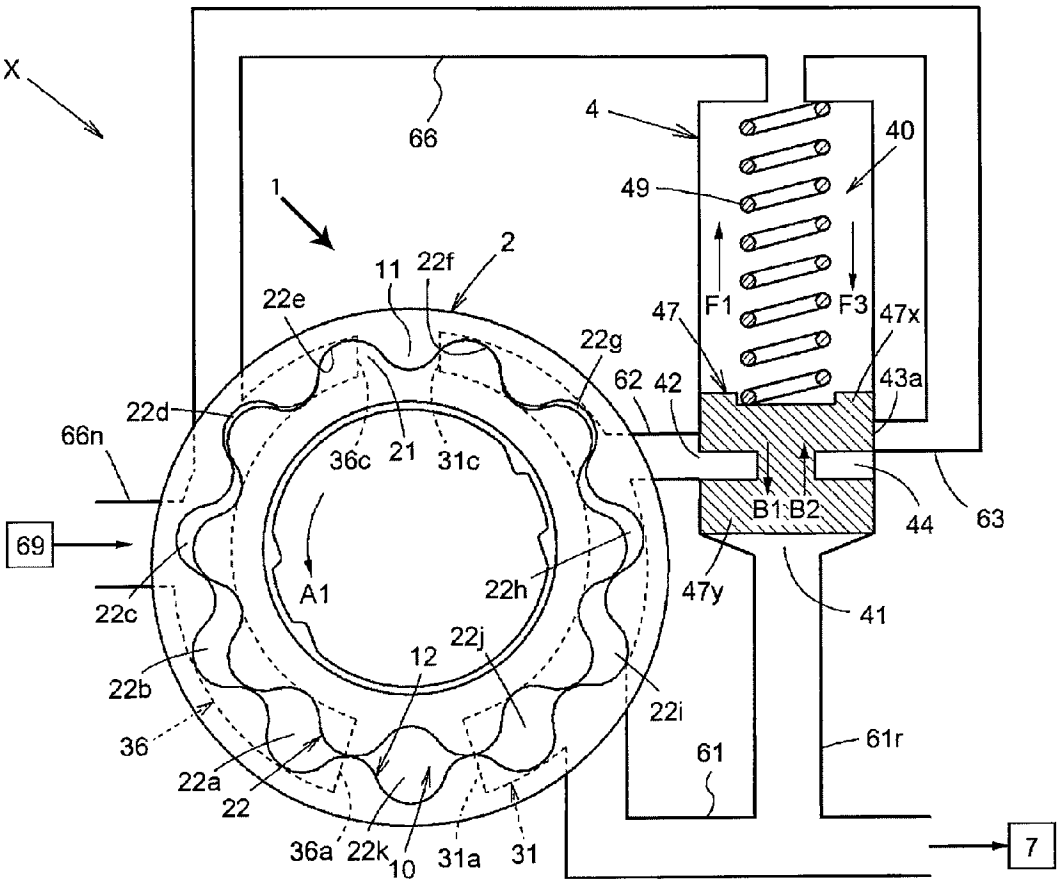
FIG. 1 is a schematic view of an oil supplying apparatus according to a first embodiment of the present invention.
Figure 2:
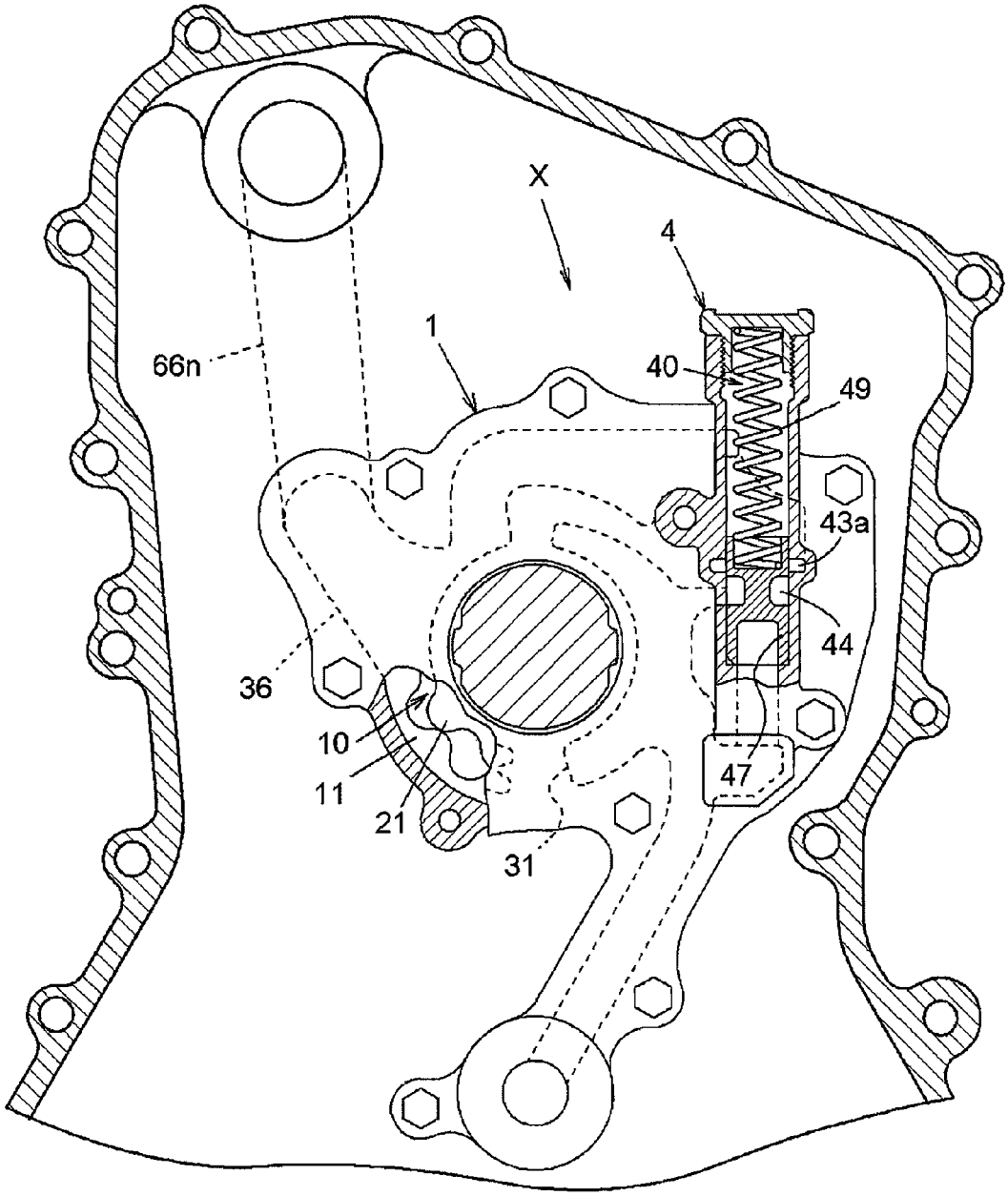
FIG. 2 is a schematic view of the oil supplying apparatus mounted on an engine according to the first embodiment of the present invention.
Figure 3:
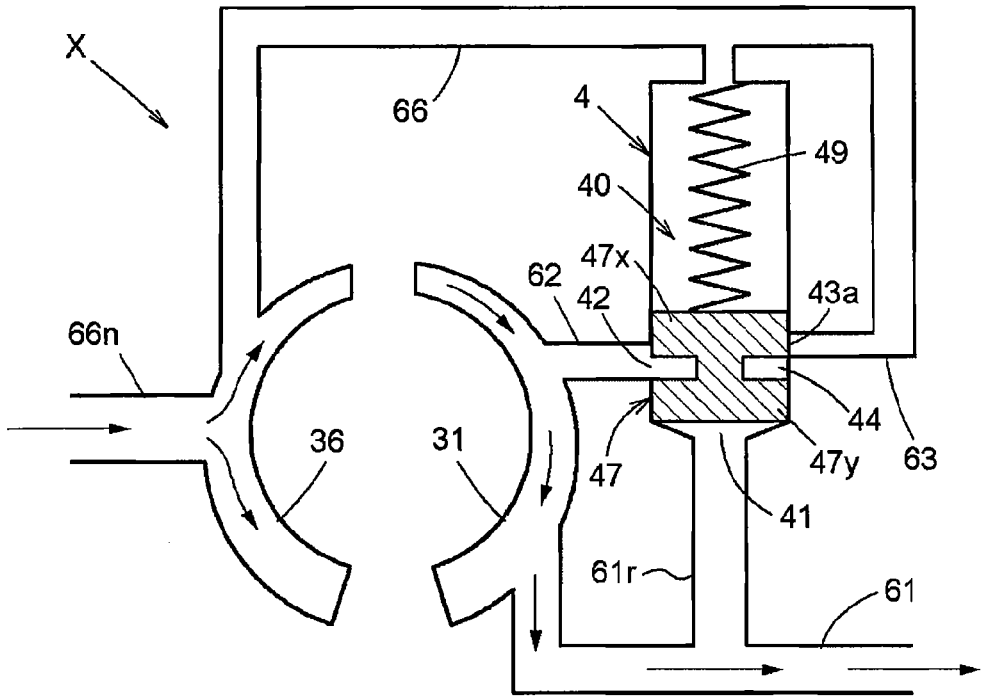
FIG. 3 is a schematic view of a main portion of the oil supplying apparatus when a rotation speed of a rotor is within a low-speed range (i.e., pattern A) according to the first embodiment of the present invention.

A first embodiment will be explained referring to FIGS. 1 to 7. As shown in FIGS. 1 and 2, an oil supplying apparatus X for an engine includes a pump body 1 having an inlet port 36 which sucks working oil in response to a rotation of a rotor 2 driven synchronously with the crankshaft and a single outlet port 31 which discharges working oil in response to a rotation of the rotor 2. The oil supplying apparatus X further includes a first oil path 61 connected to the outlet port 31 and supplying working oil from the outlet port 31 to a portion 7 to be supplied with the working oil, an oil pressure control valve 4 connected to the first oil path 61 via an intermediate oil path 61*r* and operating in response to a hydraulic pressure of working oil in the first oil path 61, a second oil path 62 connected to the outlet port 31 at an upstream side relative to a connecting portion between the outlet port 31 and the first oil path 61 and supplying the working oil from the outlet port 31 to the oil pressure control valve 4. Further, the oil supplying apparatus X includes a relief oil path 66 which returns the working oil of the oil pressure control valve 4 to at least one of the inlet port 36 and an oil pan 69 and a valve body oil path 44 provided at a valve body 47 of the oil pressure control valve 4. Structures of each member will be explained hereinafter.

A construction of the pump body 1 will be explained as follows. The pump body 1 of the oil supplying apparatus X is preferably made of metal (e.g., aluminum system alloy, iron system alloy), and a pump chamber 10 is formed in the pump body 1. The pump chamber 10 is formed with an inner teeth portion 12 constructing a driven gear including plural inner teeth 11.

A rotor 2, also preferably made of metal, is rotatably arranged in the pump chamber 10. The rotor 2 is connected to a crankshaft of an internal combustion engine serving as a drive source and rotates together with the crankshaft. The rotor 2 may be designed for rotation speeds of, for example, from 600 to 7000 rpm.

The rotor 2 is formed with an outer teeth portion 22 which provides a drive gear having plural outer teeth 21. The inner teeth 11 and the outer teeth 21 may be defined, for example, by a trochoid curve or a cycloid curve, or the like. The rotor 2 is rotated in an arrowed direction A1, the outer teeth 21 of the rotor 2 are consecutively geared with the inner teeth 11 in response to a rotation of the rotor 2 so that the inner teeth portion 12 rotates in the identical direction to the rotor 2.

The outer teeth 21 and the inner teeth 11 form pump chambers 22*a*-22*k*. In FIG. 1, the volume of the pump chamber 22*k* is the largest and the volume of the pump chambers 22*e* and 22*f* is the smallest. In those circumstances, observing the pump chambers 22*e* through 22*a* counterclockwise in FIG. 1, intake pressure is generated because the volumes of the chambers increase gradually, and thus working oil is sucked. Observing the pump chambers 22*j* through 22*f*, discharge pressure is generated because the volume of the chambers is reduced gradually, and thus the working oil is discharged.

The outlet port 31 discharges the working oil from the pump chamber 10 in response to the rotation of the rotor 2. The outlet port 31 includes end sides 31*a*, 31*c*. The pump body 1 is formed with the inlet port 36. The inlet port 36 sucks the working oil into the pump chamber 10 in response to the rotation of the rotor 2. The inlet port 36 includes end sides 36*a*, 36*c*.

A construction of a working oil supplying path will be explained hereinafter. The first oil path 61 establishes the communication between the outlet port 31 and the portion 7 to be supplied with the working oil. The portion 7 to be supplied with the working oil may correspond to, for example, a lubrication apparatus, for example, a bearing or a plain bearing which requires oil feeding, a valve train of an internal combustion engine, and a drive mechanism, for example, a cylinder or a piston of the internal combustion engine, or the like. The first oil path 61 is connected to the oil pressure control valve 4 by the intermediate oil path 61*r*.

The second oil path 62 connects the outlet port 31 and the oil pressure control valve 4, and supplies the working oil discharged from the outlet port 31 to the oil pressure control valve 4.

The relief oil path 66 returns the working oil from the oil pressure control valve 4 to at least one of the inlet port 36 and the oil pan 69. The oil pressure control valve 4 and the relief oil path 66 are connected by a first connecting path 63.

A path 66*n* which sucks the working oil from the oil pan 69 is provided so as to communicate with the inlet port 36.

A construction of the oil pressure control valve 4 will be explained as follows. The oil pressure control valve 4 includes the valve body 47 which operates in response to the pressure of the working oil in the first oil path 61. The valve body 47 is housed in a valve housing chamber 40 in which the valve body 47 is slidably arranged. The valve body 47 is provided in the valve housing chamber 40 in a state where it is being biased by a spring 49 in an arrowed direction B1.

The valve body 47 is provided with the valve body oil path 44 through which the working oil flows. The configuration of the valve body oil path 44 may be varied as long as serving as a path for the working oil which is formed by the valve body 47. For example, the valve body path 44 may be configured in a cylindrical form which penetrates through the inside of the valve body 47. The valve body path 44 may also be configured in a groove shape formed around the valve body 47. The valve body 47 includes a first valve portion 47*x* and a second valve portion 47*y* at respective ends of the valve body 47 in an operating direction. Designing of dimensions of the valve body oil path 44, the first valve portion 47*x*, and the second valve portion 47*y* in an operating direction will be explained hereinafter.

The oil pressure control valve 4 includes a first valve hole 41, a second valve hole 42, and a return hole 43*a* which are configured to be in communication with the intermediate oil path 61*r*, the second oil path 62, and the first connecting path 63, respectively. The first valve hole 41 is configured to be in communication with the first oil path 61 via the intermediate oil path 61*r*. Accordingly, the oil pressure of the working oil is transmitted to the valve body 47. The second valve hole 42 is configured to be in communication with the second oil path 62. Accordingly, the working oil from the outlet port 31 is introduced to the valve body oil path 44. The return hole 43*a* is configured to be in communication with the relief path 66 via the first connecting path 63. Accordingly, the working oil from the oil pressure control valve 4 returns to the inlet port 36.

According to the oil supplying apparatus X, in response to an increase of the rotation speed of the rotor 2, the valve body 47 of the oil pressure control valve 4 is operated in patterns A to D. The patterns A to D will be explained in association with patterns of a level of the working oil of the first oil path 61 ranged from a first pressure range to a fourth pressure range.

Pattern A corresponding to the first pressure range will be explained as follows. In a low-speed range in which rotation speed of the rotor 2 is low (e.g., up to 1500 rpm), for example, immediately after starting an engine, the working oil is supplied to the portion 7 to be supplied with the working oil by the oil pressure of the working oil in the first oil path 61 discharged from the outlet port 31. The oil pressure in the foregoing circumstances is applied to the valve body 47 via the intermediate oil path 61*r* and the first valve hole 41 of the oil pressure control valve 4. Accordingly, valve body driving force F1 which actuates the valve body 47 is generated. When the valve body driving force F1 is less than biasing force F3 of the spring 49 (i.e., F1<F3), the valve body 47 moves in the arrowed direction B1 by the spring 49 (See FIG. 1). The level of the pressure of the working oil in the first oil path 61 in the aforementioned circumstance is defined as the first pressure range.

In those circumstances, the first valve portion 47*x* of the valve body 47 closes the return hole 43*a*, and the second valve portion 47*y* closes the first valve hole 41. Thus, the second oil path 62 and the relief oil path 66 are closed and the working oil from the second oil path 62 does not flow into the oil pressure control valve 4 (See FIG. 3). Therefore, the working oil from the outlet port 31 is supplied to the first oil path 61 without going through the oil pressure control valve 4. According to the embodiments of the present invention, a closed oil path indicates a state where the working oil does not flow thereto.

Namely, when the oil pressure of the working oil of the first oil path 61 is within the first pressure range, the volume of the working oil supplied to the first oil path 61 is approximately equalized to the total volume of the working oil discharged from the outlet port 31. In those circumstances, the volume of the working oil supplied to the portion 7 to be supplied with the working oil obtains properties shown with line O-P in FIG. 7. Namely, in accordance with an increment of the rotation speed of the rotor 2 to N1 (e.g., 1500 rpm), the output volume of the working oil from the outlet port 31 increases, and thus increasing the oil pressure in the first oil path 61.

Pattern B corresponding to the second pressure range will be explained as follows. The rotation speed of the rotor 2 increments in accordance with an increment of rotation speed of the crankshaft of the internal combustion engine serving as the drive source, and when the valve body driving force F1 exceeds the biasing force F3 of the spring 49 (i.e., F1>F3) in a first middle speed range where the rotation speed of the rotor 2 exceeds a predetermined rotation speed N1, the valve body 47 moves in an arrowed direction B2 (See FIG. 1) until the valve body driving force F1 and the biasing force F3 come to balance. In the foregoing state, the oil pressure of the working oil in the first oil path 61 is defined as the second pressure range which is greater than the first pressure range.

Figure 4:
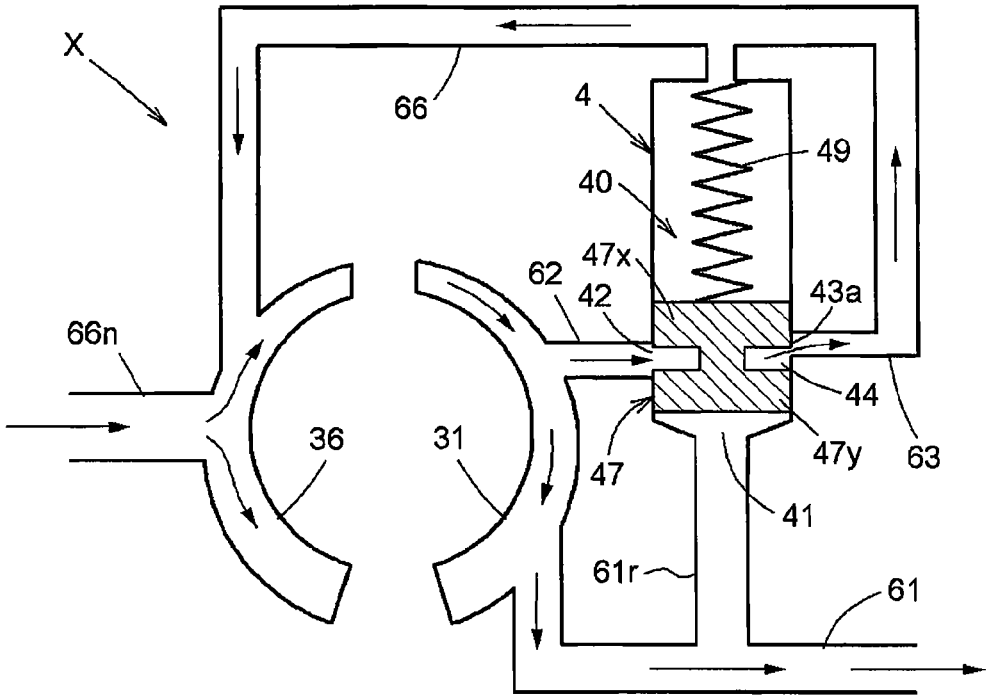
FIG. 4 is a schematic view of a main portion of the oil supplying apparatus when a rotation speed of the rotor is within a first middle speed range (i.e., pattern B) according to the first embodiment of the present invention.

In those circumstances, as shown in FIG. 4, the return hole 43*a* which has been closed by the first valve portion 47*x* is opened. In response to the opening of the return hole 43*a*, a portion of the working oil from the outlet port 31 is supplied to the first oil path 61 and the rest of the working oil from the outlet port 31 is supplied to the relief oil path 66 via the second oil path 62, the valve body oil path 44 and the first connecting path 63.

In other words, when the oil pressure of the working oil of the first oil path 61 is within the second pressure range, the volume of the working oil supplied to the first oil path 61 is defined by subtracting the volume of the working oil supplied to the relief oil path 66 from the total volume of the working oil discharged from the outlet port 31. In those circumstances, the volume of the working oil supplied to the portion 7 to be supplied with the working oil has properties shown with line P-R in FIG. 7. Namely, because the communication to the relief oil path 66 is established, an incremental ratio of the output volume of the working oil to the portion 7 to be supplied with the working oil relative to the increment of the rotation speed of the rotor 2 is reduced.

Next, a relationship between a rotation speed of the rotor 2 of the engine and required volume of the working oil at a variable valve timing control apparatus (VVT) serving as the portion 7 to be supplied with the working oil will be explained. For example, although the working oil of the approximate total output volume from the outlet port 31 is necessary immediately after the start of the engine, the total volume of the discharged working oil from the outlet port 31 is not necessary when the rotation speed of the rotor 2 exceeds the predetermined level (N1), and eventually, the required oil volume is ensured with the volume of the working oil being less than the total output volume from the outlet port 31 (i.e., the region indicated with V and hatched area in FIG. 7). Therefore, it is preferable to construct the oil supplying apparatus X so that gradients of each of the line O-P, and the line P-R exceed gradients of the required oil volume V for the VVT.

Pattern C corresponding to the third pressure range will be explained as follows. When the rotation speed of the rotor 2 is further increased and reaches a second middle speed range which is equal to or greater than N2 (e.g., 4000 rpm), the valve body 47 further moves in the arrowed direction B2 (See FIG. 1). In those circumstances, the oil pressure of the working oil in the first oil path 61 is defined as the third pressure range which is greater than the second pressure range.

Figure 5:
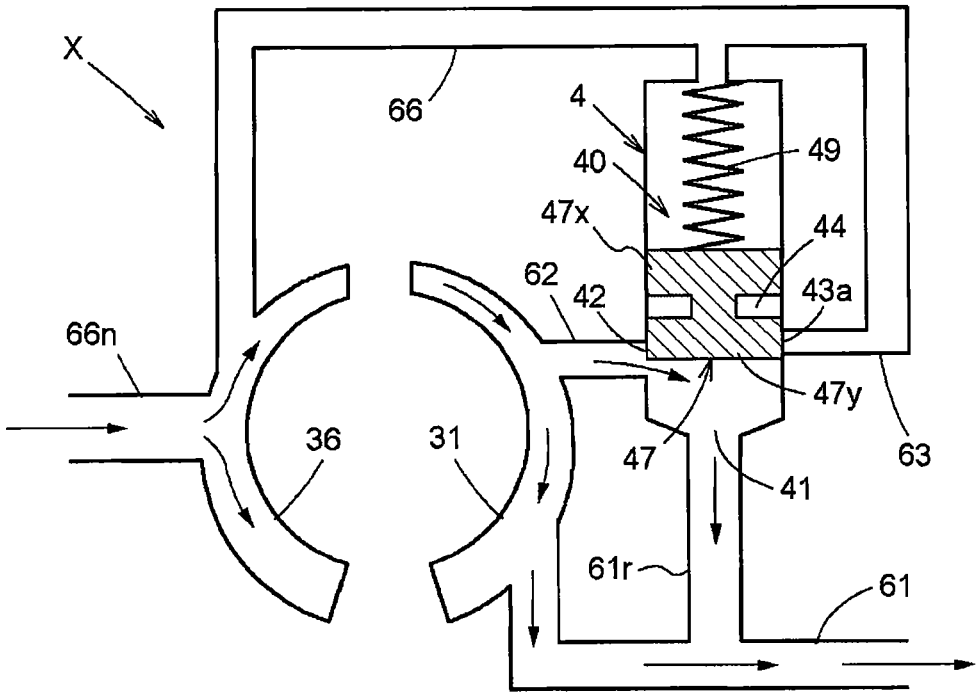
FIG. 5 is a schematic view of a main portion of the oil supplying apparatus when a rotation speed of the rotor is within a second middle speed range (i.e., pattern C) according to the first embodiment of the present invention.

In those circumstances, as shown in FIG. 5, the second valve hole 42 comes to be in communication with the second oil path 62 and the second valve portion 47*y* of the valve body 47 closes the return hole 43*a*, thus to close the relief oil path 66. Because the supply of the working oil to the relief oil path 66 is stopped, the destination of the working oil is changed to the first oil path 61 instead of the relief oil path 66. Accordingly, in addition to directly supplying the working oil from the outlet port 31 to the first oil path 61, the working oil outputted from the outlet port 31 merges the first oil path 61 through the second oil path 62, the oil pressure control valve 4, and the intermediate oil path 61*r*. Namely, when the oil pressure of the working oil in the first oil path 61 is within the third pressure range, the supplied volume of the working oil to the portion 7 to be supplied with the working oil becomes the total output volume of the working oil from the outlet port again. In those circumstances, the volume of the oil supplied to the portion 7 to be supplied with the working oil has properties indicated with line R-T in FIG. 7. In other words, the supplied volume of the working oil to the portion 7 to be supplied with the working oil increases (i.e., shown with line R-S in FIG. 7), and thereafter the total output volume from the outlet port 31 is supplied to the portion 7 to be supplied with the working oil (i.e., shown with line S-T in FIG. 7).

Pattern D corresponding to the fourth pressure range will be explained as follows. When the rotation speed of the rotor 2 further increases and reaches a high-speed range equal to or greater than N3 (e.g., 4500 rpm), the valve body 47 further moves in the arrowed direction B2 (See FIG. 1). In those circumstances, the oil pressure of the working oil in the first oil path 61 is defined as the fourth pressure range which is greater than the third pressure range.

Figure 6:
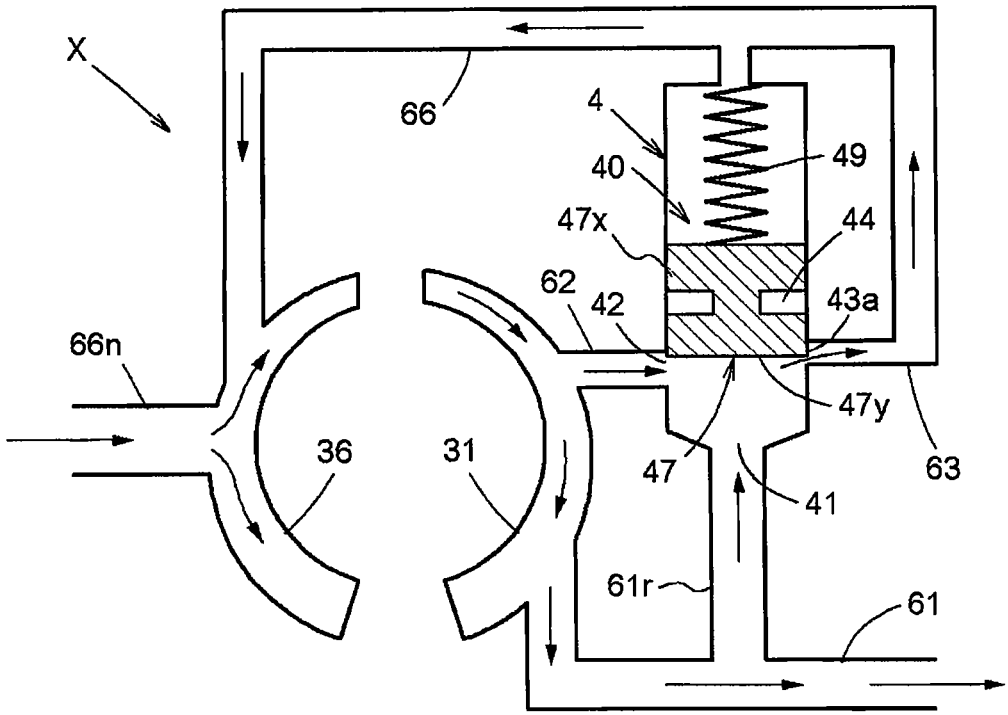
FIG. 6 is a schematic view of a main portion of the oil supplying apparatus when a rotation speed of the rotor is within a high-speed range (i.e., pattern D) according to the first embodiment of the present invention.

In the foregoing circumstances, as shown in FIG. 6, the return hole 43*a* closed by the valve body 47 is unclosed. Therefore, the working oil from the outlet port 31 is supplied to the first oil path 61 and the working oil from the outlet port 31 is also supplied to the relief oil path 66 through the second oil path 62 or the intermediate oil path 61*r* by establishing the communication between the second oil path 62, the intermediate oil path 61*r*, and the relief oil path 66 at the oil pressure control valve 4.

Namely, when the oil pressure of the working oil in the first oil path 61 is within the fourth pressure range, the supplied volume of the working oil to the potion 7 to be supplied with the working oil is defined by subtracting the volume of the working oil supplied to the relief oil path 66 from the total output volume of the working oil from the outlet port 31. In those circumstances, the volume of the oil supplied to the portion 7 to be supplied with the working oil has properties indicated with line T-U in FIG. 7. Because the communication to the relief oil path 66 is established, an incremental ratio of the output volume of the working oil to the portion 7 to be supplied with the working oil relative to an increase of the rotation speed of the rotor 2 is reduced.

Next, a relationship between the rotation speed of the rotor 2 of the engine and the required oil volume of a jet for a piston serving as the portion 7 to be supplied with the working oil will be explained. For example, although the supplied oil volume is approximately equivalent to the total output volume from the outlet port 31 when reaching the high speed range of the rotation of the rotor 2 (i.e., N3), when the rotation speed of the rotor 2 exceeds the predetermined rotation speed (N3), the working oil equivalent to the total output volume from the outlet port 31 is not necessary (i.e., region indicated with W and hatched area in FIG. 7 indicates the required oil volume for, for example, the jet for the piston). Accordingly, it is preferable to structure the oil supplying apparatus X so that gradients of the line T-U in FIG. 7 exceed the oil volume W required for the jet for the piston.

With the construction according to the embodiment of the present invention, because of the single outlet port 31 and the single valve body oil path 44 provided at the valve body 47, the oil supplying apparatus X is constructed in a simple structure. Even with the simplified structure, according to the oil supplying apparatus X, the required volume of the working oil to be supplied to the portion 7 to be supplied with the working oil is securely ensured even at the high-speed state of the engine as explained hereinbelow.

When the oil pressure of the working oil in the first oil path 61 is within the first pressure range, the second oil path 62 and the relief oil path 66 are closed by the valve body 47 of the oil pressure control valve 4 so that the working oil from the outlet port 31 is supplied to the first oil path 61. In those circumstances, the volume of the working oil supplied to the portion 7 to be supplied with the working oil becomes the equivalent of the total output volume of the working oil from the outlet port 31 (i.e., See line O-P in FIG. 7).

When the oil pressure of the working oil in the first oil path 61 is within the second pressure range where the oil pressure of the working oil discharged from the outlet port 31 is greater than the first pressure range because of increments of the rotation speed of the internal combustion engine and the rotation speed of the rotor 2 and where the necessary level of oil pressure is ensured, the working oil from the outlet port 31 is supplied to the first oil path 61. In the meantime, a portion of the working oil is supplied to the relief oil path 66 via the second oil path 62 and the valve body oil path 44 instead of the portion 7 to be supplied with the working oil (i.e., line P-R in FIG. 7). Consequently, when the necessary level of the oil pressure is ensured, the excessive work is reduced or avoided, and thus the driving power of the oil supplying apparatus X is reduced by the reduced or avoided excessive work.

For example, for the jet for the piston, or the like, applied as the portion 7 to be supplied with the working oil, significant volume of the working oil needs to be supplied to the piston quickly when the rotation speed of the rotor 2 is at the high-speed range. With the construction of the oil supplying apparatus X according to the embodiment of the present invention, when the oil pressure of the working oil in the first oil path 61 is within the third pressure range which is greater than the second pressure range, the relief oil path 66 is closed by the valve body 47 so that the working oil from the outlet port 31 is supplied to the first oil path 61, and also the working oil outputted from the outlet port 31 to the second oil path 62 merges the first oil path 61 through the oil pressure control valve 4 and the intermediate oil path 61*r*. In those circumstances, even after the supplied volume of the working oil to the first oil path 61 is once reduced in the second pressure range, the supplied volume of the working oil to the portion 7 to be supplied with the working oil becomes the equivalent of the total volume of the working oil from the outlet port 31 once again (i.e., line S-T in FIG. 7).

Thereafter, when the oil pressure of the working oil in the first oil path 61 is within the fourth pressure range in which the oil pressure of the working oil discharged from the outlet port 31 is greater than the predetermined volume because of an increase of the rotation speed of the rotor 2 and the rotation speed of the internal combustion engine, and in which the necessary oil pressure is ensured, in addition to supplying the working oil from the outlet port 31 to the first oil path 61, the working oil in the outlet port 31 is supplied to the relief oil path 66 by establishing the communication between the second oil path 62, the intermediate oil path 61*r*, and the relief oil path 66 at the oil pressure control valve 4. Thus, the excessive working oil is supplied to the relief oil path 66 via the oil pressure control valve 4 instead of the first oil path 61 (i.e., line T-U in FIG. 7), and the excessive work is reduced or avoided accordingly.

As explained above, according to the embodiment of the present invention, because the oil supplying apparatus X is configured to re-increase the volume of the working oil supplied to the portion 7 to be supplied with the working oil when the rotation speed of the rotor reaches the high-speed range, the required volume of the oil to be supplied to the portion 7 to be supplied with the working oil is securely ensured.

According to the embodiment explained above, dimensions of the valve body oil path 44, the first valve portion 47*x*, and the second valve portion 47*y* in the operating direction at the oil pressure control valve 4 are designed to meet conditions described hereinbelow. First, in Pattern A (FIG. 3), when the first valve portion 47*x* closes the return hole 43*a*, the second valve portion 47*y* closes the first valve hole 41 and the second valve hole 42 so that the first valve hole 41 and the second valve hole 42 do not communicate with each other. Second, in Pattern B (FIG. 4), when the first valve portion 47*x* uncloses the return hole 43*a*, the second valve portion 47*y* maintains the first valve hole 41 and the second valve hole 42 closed so that the first valve hole 41 and the second valve hole 42 do not communicate with each other. Third, in Pattern C (FIG. 5), when the second valve portion 47*y* closes the return hole 43*a*, the communication between the first valve hole 41 and the second valve hole 42 is established. Fourth, in Pattern D (FIG. 6), when the second valve portion 47*y* uncloses the return hole 43*a*, the communication between the first valve hole 41 and the second valve hole 42 is maintained.

Accordingly, a precise dimensional relationship is required in the dimensions of the valve body oil path 44, the first valve portion 47*x*, and the second valve portion 47*y* in the operating direction. In case the dimensional relationship explained above cannot be obtained, for example, an increase of the driving power and damage of the pump body 1 may occur due to an abnormal increase of the pressure in the outlet port 31 and/or the first oil path 61 because the second oil path 62 is closed. However, with the construction of the oil supplying apparatus X according to the embodiment of the present invention, the required volume of the working oil can be supplied to the portion 7 without excessively increasing the oil pressure.

A second embodiment of the present invention will be explained as follows. In the construction of the first embodiment, the oil pressure control valve 4 is connected to the relief oil path 66 via the single first connecting path 63. Structures of the connection of the oil pressure control valve 4 and the relief oil path 66 according to the present invention are not however limited to this first embodiment, and the oil pressure control valve 4 and the relief oil path 66 may alternatively be connected for example via plural connecting paths.

For example, as shown in FIGS. 8-11, the oil pressure control valve 4 and the relief oil path 66 are connected via the first connecting path 63 and a second connecting path 64. The oil pressure control valve 4 is provided with a return hole 43*b* which is connected to the second connecting path 64. In the valve body 147 of the second embodiment, designs of the dimensions of the valve body oil path 44, the first valve portion 147*x*, and the second valve portion 147*y* in the operating direction are different from the first embodiment. Other aspects of the construction are largely identical to the first embodiment, and thus explanations will not be repeated.

With the construction of the oil supplying apparatus X according to the second embodiment, in response to an increment of the rotation speed of the rotor 2, the valve body 147 of the oil pressure control valve 4 expresses Patterns A'-D' which may be explained as follows. Levels of the working oil in the first oil path 61 will be explained in the Patterns A'-D' respectively corresponding to the first pressure range, the second pressure range, the third pressure range and the fourth pressure range. Because the definitions of the first pressure range through the fourth pressure range of the second embodiment are identical to the first embodiment in which the first pressure range through the fourth pressure range are defined on the basis of the relationship between the rotation speed of the rotor 2 and the oil pressure of the working oil in the first oil path 61, explanations will not be repeated.

Pattern A' corresponding to the first pressure range will be explained as follows. As shown in FIG. 8, in Pattern A', the first valve portion 147*x* of the valve body 147 closes the return hole 43*a* and the second valve portion 147*y* closes the return hole 43*b* so that the valve body 147 closes the second oil path 62 and the relief path 66. Accordingly, the working oil from the second oil path 62 does not flow into the oil pressure control valve 4, and the working oil from the outlet port 31 is supplied to the first oil path 61. Namely, when the oil pressure of the working oil in the first oil path 61 is within the first pressure range, the volume of the working oil supplied to the portion 7 to be supplied with the working oil becomes the total output volume of the working oil discharged from the outlet port 31 (i.e., line O-P of FIG. 7).

Figure 9:
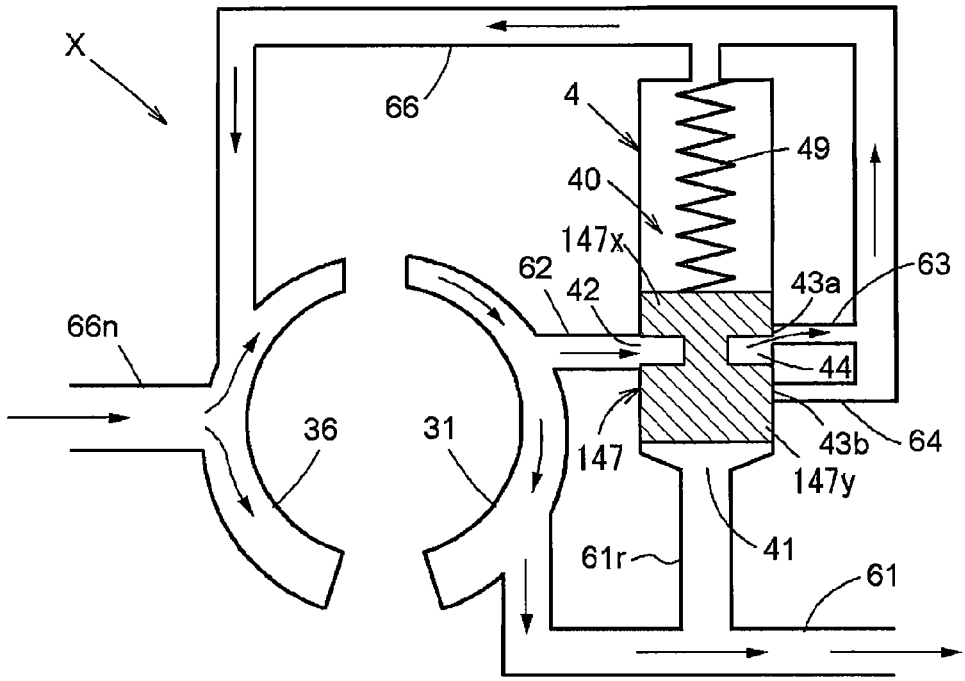
FIG. 9 is a schematic view of a main portion of the oil supplying apparatus when a rotation speed of the rotor is within a first middle speed range (i.e., pattern B') according to the second embodiment of the present invention.

Pattern B' corresponding to the second pressure range will be explained as follows. As shown in FIG. 9, although the return hole 43*a* closed by the second valve portion 147*x* is unclosed, the return hole 43*b* is remained closed by the second valve portion 147*y*. In other words, the second connecting path 64 is closed by the valve body 147. In those circumstances, a portion of the working oil from the outlet port 31 is supplied to the first oil path 61 and the rest of the working oil is supplied to the relief oil path 66 via the second oil path 62, the valve body oil path 44 of the oil pressure control valve 4, and the first connecting path 63.

Figure 7:
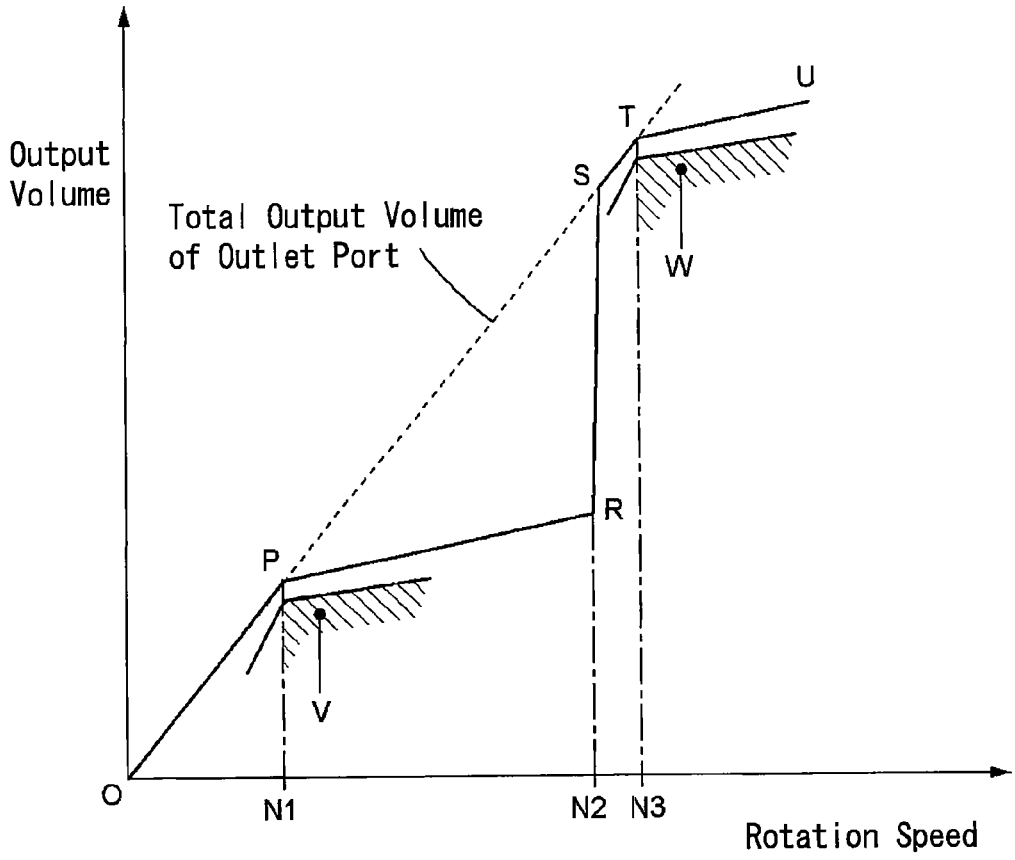
FIG. 7 is a graph showing a relationship between a rotation speed of the rotor of an engine and output volume of working oil of an outlet port group.
Figure 8:
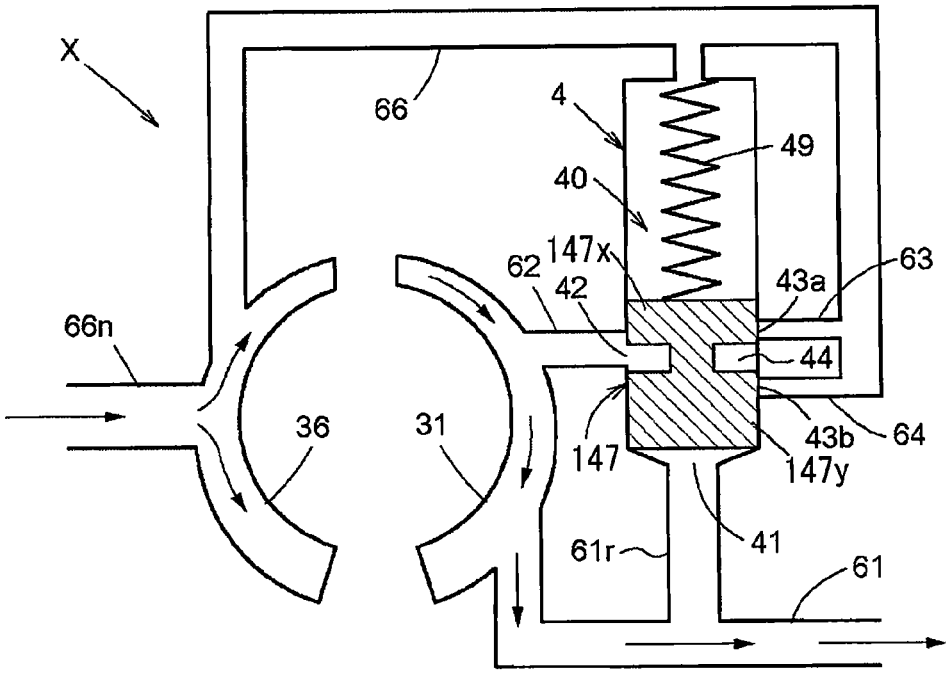
FIG. 8 is a schematic view of a main portion of the oil supplying apparatus when a rotation speed of a rotor is within a low-speed range (i.e., pattern A') according to a second embodiment of the present invention.

Namely, when the oil pressure of the working oil in the first oil path 61 is within the second pressure range, the volume of the working oil supplied to the portion 7 to be supplied with the working oil is defined by subtracting working oil supplied to the relief oil path 66 via the first connecting path 63 from the total output volume outputted from the outlet port 31 (i.e., line P-R in FIG. 7). In those circumstances, by changing a diameter, or the like, of the first connecting path 63 variously, gradients of the line P-R in FIG. 7 may be changed as desired.

Figure 10:
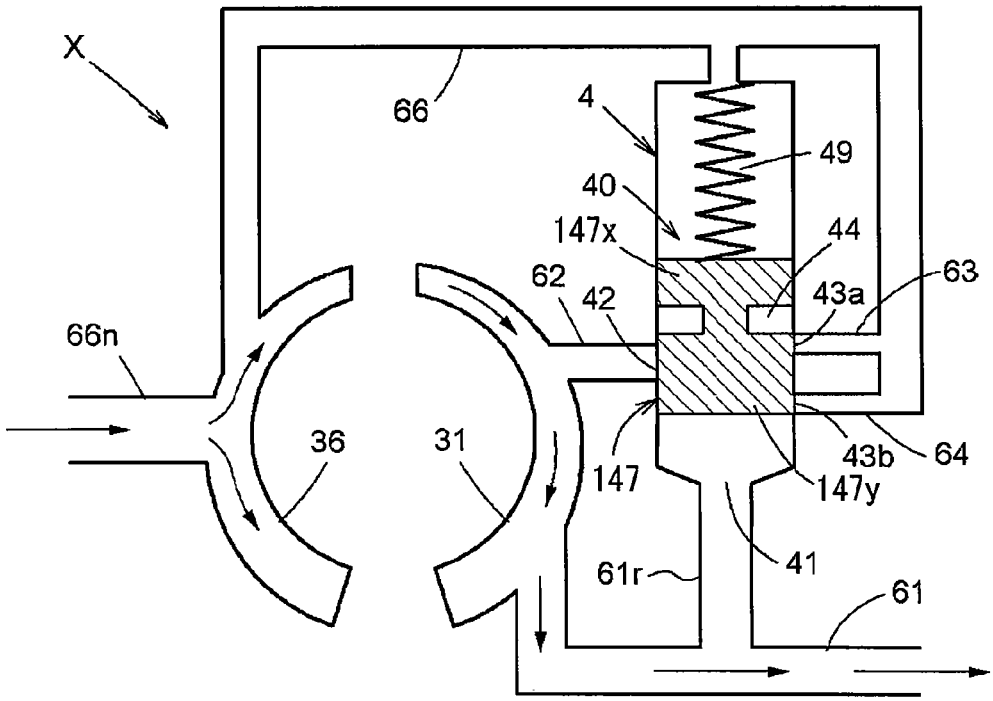
FIG. 10 is a schematic view of a main portion of the oil supplying apparatus when a rotation speed of the rotor is within a second middle speed range (i.e., pattern C') according to the second embodiment of the present invention.

Pattern C' corresponding to the third pressure range will be explained as follows. As shown in FIG. 10, the second valve portion 147*y* closes the second valve hole 42, the return hole 43*a*, and the return hole 43*b*, and thus the second oil path 62 and the relief oil path 66 are closed by the valve body 147. Accordingly, the working oil from the second oil path 62 does not flow into the oil pressure control valve 4, and the working oil from the outlet port 31 is supplied to the first oil path 61 without passing through the oil pressure control valve 4. Namely, when the oil pressure of the working oil in the first oil path 61 is within the third pressure range, the volume of the working oil supplied to the portion 7 to be supplied with the working oil becomes the total output volume discharged from the outlet port 31 (i.e., See line R-T in FIG. 7).

Figure 11:
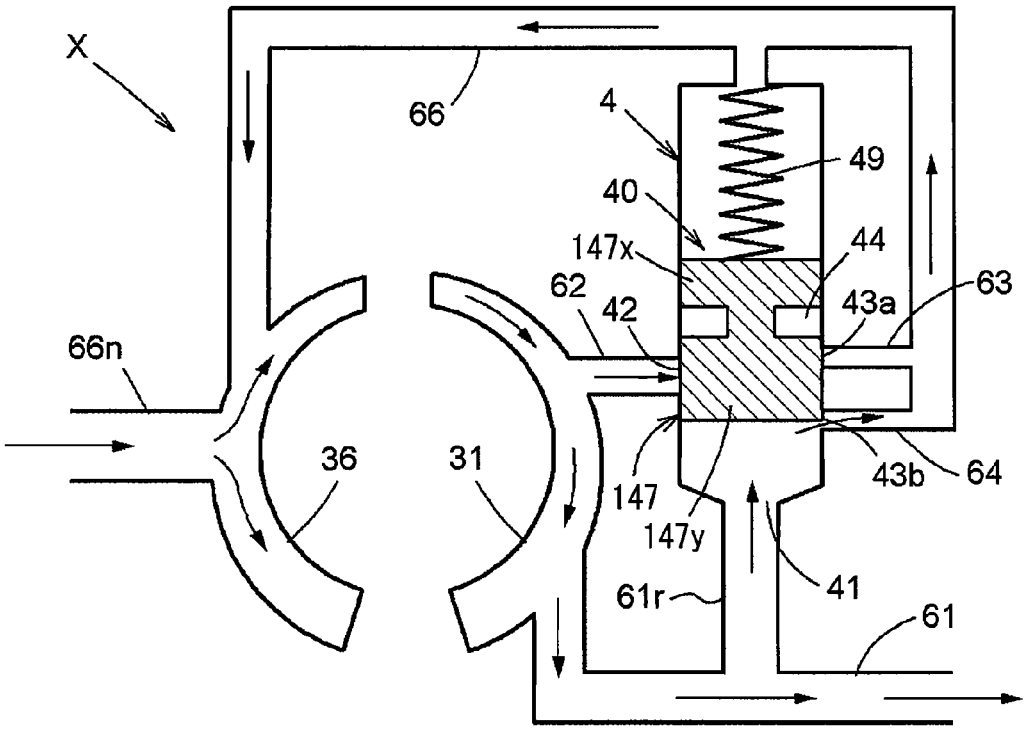
FIG. 11 is a schematic view of a main portion of the oil supplying apparatus when a rotation speed of the rotor is within a high-speed range (i.e., pattern D') according to the second embodiment of the present invention.

Pattern D' corresponding to the fourth pressure range will be explained as follows. As shown in FIG. 11, the return hole 43*b* closed by the second valve portion 147*y* is unclosed. The second valve hole 42 and the return hole 43*a* are remained closed by the second valve portion 147*y*. That is, the second oil path 62 and the first connecting path 63 are closed by the valve body 147, and the communication between the intermediate oil path 61*r* and the relief oil path 66 is established at the oil pressure control valve 4. Accordingly, the working oil from the outlet port 31 is supplied to the first oil path 61 and is supplied to the relief oil path 66 via the second connecting path 64.

Namely, when the oil pressure of the working oil in the first oil path 61 is within the fourth pressure range, the volume of the working oil supplied to the portion 7 to be supplied with the working oil is defined by subtracting the working oil supplied to the relief oil path 66 via the second connecting path 64 from the total volume of the working oil discharged from the outlet port 31 (i.e., See line T-U in FIG. 7).

According to the second embodiment, two connecting paths 63, 64 which supply the working oil from the oil pressure control valve 4 to the relief oil path 66 are provided. With this construction, comparing to the case where a single connecting path is provided, a relief timing to supply the working oil from the oil pressure control valve 4 to the relief oil path 66 is readily matched to rotation speed ranges of the engine. Thus, the degree of freedom in designing oil pressure control valve 4 increases. According to the second embodiment, likewise the construction of the first embodiment, the construction of the oil supplying apparatus X is simplified. However, even with the oil supplying apparatus X with simple construction, the necessary volume of the working oil supplied to the portion 7 to be supplied with the working oil is securely ensured even at the high-speed rotation of the engine as explained hereinbelow.

When the oil pressure of the working oil in the first oil path 61 is within the first pressure range, the second oil path 62 and the relief oil path 66 are closed by the valve body 147 of the oil pressure control valve 4 so that the working oil from the outlet port 31 is supplied to the first oil path. In those circumstances, the volume of the working oil supplied to the portion 7 to be supplied with the working oil becomes the total volume of the working oil from the outlet port 31 (i.e., See line O-P in FIG. 7).

Within the second pressure range in which the oil pressure of the working oil outputted from the outlet port 31 is greater than the first pressure range by an increase of the rotation speed of the internal combustion engine and an increase of the rotation speed of the rotor 2 and the necessary oil pressure is ensured, the working oil from the outlet port 31 is supplied to the first oil path 61. In the meantime, the second connecting path 64 is closed by the valve body 147, and the working oil is supplied to the relief oil path 66 via the second oil path 62, the valve body oil path 44, and the first connecting path 63 so that the excessive working oil is not supplied to the portion 7 to be supplied with the working oil (i.e., line P-R in FIG. 7).

On the other hand, for example, in a case where a jet for a piston is applied as the portion 7 to be supplied with the working oil, significant volume of working oil needs to be supplied to the piston quickly when the rotation speed of the rotor 2 is in the high-speed range. Thus, according to the second embodiment, when the oil pressure of the working oil in the first oil path 61 is within the third pressure range which is greater than the second pressure range, the second oil path 62 and the relief oil path 66 are closed by the valve body 147 so that the working oil from the outlet port 31 is supplied to the first oil path 61. In those circumstances, even after the volume of the working oil supplied to the first oil path 61 is once reduced at the second pressure range, the volume of the working oil supplied to the portion 7 to be supplied with the working oil is resumed to be the total volume from the outlet port 31 (i.e., line S-T in FIG. 7). Accordingly, because the volume of the working oil to be supplied is increased again at the high-speed range of the rotation speed of the rotor 2, the necessary oil volume supplied to the portion 7 to be supplied with the working oil is securely ensured.

Thereafter, within the fourth pressure range in which the oil pressure of the working oil outputted from the outlet port 31 is assumed to be greater than a predetermined volume by an increase of the rotation speed of the internal combustion engine and an increase of the rotation speed of the rotor 2 and the necessary oil pressure is ensured, the working oil from the outlet port 31 is supplied to the first oil path 61. In the meantime, when the working oil in the first oil path 61 is within the fourth pressure range, the valve body 147 closes the second oil path 62 and the first connecting path 63 and the communication between the intermediate oil path 61*r* and the relief path 66 is established at the oil pressure control valve 4 to supply the working oil of the outlet port 31 to the relief oil path 66 via the second connecting path 64. Accordingly, the working oil is supplied to the relief path 66 via the oil pressure control valve 4 without supplying the excessive working oil to the first oil path 61 (i.e., line T-U in FIG. 7), and thus the excessive work is reduced, or avoided.

As foregoing, with the oil supplying apparatus X according to the embodiment of the present invention, because the volume of the working oil to be supplied is increased again at the high-speed range of the rotation speed of the rotor 2, the necessary volume of the working oil to be supplied to the portion 7 to be supplied with the working oil is securely ensured.

According to the second embodiment, dimensions of the valve body oil path 44, the first valve portion 147*x*, the second valve portion 147*y* of the oil pressure control valve 4 are designed to meet conditions described hereinafter. First, as shown in Pattern A' (FIG. 8), when the first valve portion 147*x* closes the return hole 43*a* and the second valve portion 147*y* closes the return hole 43*b*, the second valve portion 147*y* closes the first valve hole 41 and the second valve hole 42 not to communicate with each other. Second, as shown in. Pattern B' (FIG. 9), when the first valve portion 147*x* uncloses the return hole 43*a* and the second valve portion 147*y* keeps the return hole 43*b* closed, the second valve portion 147*y* keeps the first valve hole 41 and the second valve hole 42 closed so that the communication between the first valve hole 41 and the second valve hole 42 is blocked. Third, as shown in Pattern C' (i.e., FIG. 10), when the second valve portion 147*y* closes the return hole 43*a* and the return hole 43*b*, the second valve portion 147*y* keeps the first valve hole 41 and the second valve hole 42 closed so that the communication between the first valve hole 41 and the second valve hole 42 is not established. Fourth, as shown in Pattern D' (i.e., FIG. 11), when the second valve portion 147*y* keeps the return hole 43*a* closed and uncloses the return hole 43*b*, the second valve portion 147*y* keeps the first valve hole 41 and the second valve hole 42 closed so that the communication between the first valve hole 41 and the second valve hole 42 is not established.

Accordingly, a precise dimensional relationship is required in the dimensions of the valve body oil path 44, the first valve portion 147*x*, and the second valve portion 147*y* in an operating direction. However, by providing two return holes and arranging the return holes spaced from each other in the operating direction, it becomes easier to select which return hole is used to release the working oil depending on the position of the valve body 147. Accordingly, comparing to the case where a single return hole is provided likewise the first embodiment, the degrees of freedom in designing the oil pressure control valve 4 increase.

The embodiments of the present invention are applicable as the oil supplying apparatus X which is used for lubricating the internal combustion engine.

According to the subject matter of the oil supplying apparatus X for the engine, because the single outlet port 31 is provided, it is not necessary to provide a partition which defines a main outlet port and a sub outlet port in the pump body. Accordingly, the construction of the oil supplying apparatus X is simplified and downsized, the mountability to the engine is enhanced, and thus the manufacturing cost is reduced. Even with the simplified construction, the oil supplying apparatus X securely ensures the necessary oil volume to be supplied to the portion 7 to be supplied with the working oil at the high-speed rotation of the engine.

By closing the second oil path 62 and the relief oil path 66 by the valve body 47 of the oil pressure control valve 4 so that the working oil from the outlet port 31 is supplied to the first oil path 61 when the oil pressure of the working oil in the first oil path 61 is within the first pressure range, the supplied volume of the working oil to the portion 7 to be supplied with the working oil is assumed to be the total output volume from the outlet port 31 (i.e., line O-P in FIG. 7).

When the working oil in the first oil path 61 is within the second pressure range in which the working oil in the first oil path 61 discharged from the outlet port 31 is greater than that of in the first pressure range by an increase of the rotation speed of the internal combustion engine and the rotation speed of the rotor 2 and in which the necessary oil pressure is ensured, the working oil from the outlet port 31 is supplied to the first oil path 61. In the meantime, a portion of the working oil is supplied to the relief oil path 66 via the second oil path 62 and the valve body oil path 44 instead of being supplied to the portion 7 to be supplied with the working oil (See line P-R). In consequence, when the necessary oil pressure is ensured, the excessive work is reduced and avoided, and thus the driving power of the oil supplying apparatus X is reduced.

On the other hand, when a rotation speed of the rotor 2 is in high-speed range, significant volume of the working oil may be required to be supplied to the piston serving as a portion 7 to be supplied with the working oil quickly. Thus, according to the embodiment of the present invention, when the oil pressure of the working oil in the first oil path 61 is within the third pressure range which is greater than the second pressure range, the relief oil path 66 is closed by the valve body 47, the working oil from the outlet port 31 is directly supplied to the first oil path 61, and the working oil from the outlet port 31 is supplied to merge the first oil path 61 via the second oil path 62, the oil pressure control valve 4, and the intermediate oil path 61*r*. In those circumstances, the supplied volume of the working oil to the portion 7 to be supplied with the working oil becomes the total output volume outputted from the outlet port 31 again (i.e., line S-T in FIG. 7).

Thereafter, when the oil pressure of the working oil in the first oil path 61 is within the fourth pressure range in which the oil pressure of the working oil outputted from the outlet port 31 is greater than the predetermined volume by an increase of the rotation speed of the internal combustion engine and the rotation speed of the rotor 2, and in which the necessary oil pressure is ensured, the working oil from the outlet port 31 is supplied to the first oil path 61 and is supplied to the relief oil path 66 by establishing the communication between the second oil path 62, the intermediate oil path 61*r*, and the relief oil path 66 at the oil pressure control valve 4. Accordingly, the excessive working oil is supplied to relief oil path 66 instead of the first oil path 61 (i.e., line T-U in FIG. 7), thus the excessive work is reduced or avoided.

Accordingly, with the construction of the embodiment of the present invention, because the volume of the working oil supplied to the portion to be supplied with the working oil is increases again at the high-speed range of the rotation speed of the rotor 2, the necessary oil volume supplied to the portion 7 to be supplied with the working oil is securely ensured.

According to the subject matter of the oil supplying apparatus X, two connecting paths 63, 64, which supply the working oil from the oil pressure control valve 4 to the relief oil path 66, are provided. With the foregoing construction, compared to the case where the single connecting path is provided, the relief timing of the working oil from the oil pressure control valve 4 is more readily matched to the rotation speed ranges of the engine. Consequently, the degrees of freedom of the design of the oil pressure control valve 4 are increased.

Further, according to the present invention, because the single outlet port is provided, it is not necessary to provide a partition which separates a main outlet port and a sub-outlet port on the pump body. Thus, the structure of the oil supplying apparatus X is simplified and downsized, the mountability to the engine is improved, and the manufacturing cost of the oil supplying apparatus X is reduced. Accordingly, with the simple oil supplying apparatus X, the necessary oil volume supplied to the portion 7 to be supplied with the working oil is securely ensured even at the high-speed rotation of the engine explained as follows.

When the oil pressure of the working oil in the first oil path is within the first pressure range, the second oil path 62 and the relief oil path 66 are closed by the valve body 147 of the oil pressure control valve 4 so that the working oil from the outlet port 31 is supplied to the first oil path 61, the supplied volume of the working oil to the portion 7 to be supplied with the working oil is assumed to be the total output volume from the outlet port (i.e., line O-P in FIG. 7).

When the oil pressure in the first oil path 61 is within the second pressure range in which the oil pressure of the working oil outputted from the outlet port 31 is greater than that of in the first pressure range by an increase of the rotation speed of the internal combustion engine and the rotation speed of the rotor 2 and in which the necessary pressure is ensured, the working oil from the outlet port 31 is supplied to the first oil path 61. In the meantime, a portion of the working oil is supplied to the relief oil path 66 via the second oil path 62, the valve body oil path 44, and the first connecting path 63 by closing the second connecting path 64 by the valve body 147 instead of being supplied to the portion 7 to be supplied with the working oil (i.e., line P-R in FIG. 7). In consequence, when the required oil pressure is ensured, the excessive work is reduced or avoided, and the driving power of the oil supplying apparatus X is reduced by the reduced or avoided work.

On the other hand, when the rotation speed of the rotor 2 is at the high-speed range, the significant volume of the working oil is required to be supplied to, for example, the piston serving as the portion 7 to be supplied with the working oil. Thus, when the oil pressure of the working oil in the first oil path 61 is within the third pressure range which is greater than the second pressure range, the second oil path 62 and the relief oil path 66 are closed by the valve body 147 so that the working oil from the outlet port 31 is supplied to the first oil path 61. In those circumstances, the supplied volume of the working oil to the portion 7 to be supplied with the working oil is assumed to be the total output volume from the outlet port 31 (i.e., line S-T in FIG. 7) again.

Thereafter, when the oil pressure in the first oil path 61 is within the fourth pressure range in which the oil pressure of the working oil outputted from the outlet port 31 is greater than the predetermined level by an increase of the rotation speed of the internal combustion engine and an increase of the rotation speed of the rotor 2 and in which the necessary oil pressure is ensured, the working oil from the outlet port 31 is supplied to the first oil path 61 and is supplied to the relief oil path 66 via the second connecting path 64 by closing the second oil path 62 and the first connecting path 63 and by establishing the communication between the intermediate oil path 61*r* and the relief oil path 66 at the oil pressure control valve 4. Accordingly, the excessive working oil is supplied to the relief oil path 66 via the oil pressure control valve 4 without being supplied to the first oil path 61 (i.e., line T-U in FIG. 7), and thus the excessive work is reduced or avoided.

As explained above, according to the embodiment of the present invention, because the volume of the working oil to be supplied to the portion 7 to be supplied with the working oil is further increased at the high-speed range of the rotation speed of the rotor 2, the necessary oil volume to be supplied to the portion 7 to be supplied with the working oil is securely ensured.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and foreseeable equivalents which fall within the spirit and scope of the present invention as defined in the claims, be embraced thereby.

We claim:

1. An oil supplying apparatus for an engine, comprising:

a pump body including an inlet port sucking working oil in response to a rotation of a rotor driven synchronously with a crankshaft and an outlet port discharging the working oil in response to the rotation of the rotor;

a first oil path connected to the outlet port and supplying the working oil from the outlet port to a portion to be supplied with the working oil;

an oil pressure control valve connected to the first oil path via an intermediate oil path and operating in response to an oil pressure of the working oil in the first oil path;

a second oil path connected to the outlet port at an upstream side relative to a connecting portion between the outlet port and the first oil path and supplying the working oil from the outlet port to the oil pressure control valve;

a relief oil path returning the working oil of the oil pressure control valve to at least one of the inlet port and an oil pan; and a valve body oil path provided at a valve body of the oil pressure control valve; wherein the second oil path and the relief oil path are closed by the valve body of the oil pressure control valve when oil pressure of the working oil in the first oil path is within a first pressure range so that the working oil from the outlet port is supplied to the first oil path;

the working oil from the outlet port is supplied to the first oil path and is supplied to the relief oil path via the second oil path and the valve body oil path of the oil pressure control valve when oil pressure of the working oil in the first oil path is within a second pressure range which is greater than the first pressure range;

the relief oil path is closed by the valve body of the oil pressure control valve, the working oil from the outlet port is directly supplied to the first oil path and is supplied to merge into the first oil path via the second oil path, the oil pressure control valve, and the intermediate oil path when oil pressure of the working oil in the first oil path is within a third pressure range which is greater than the second pressure range; and the working oil from the outlet port is supplied to the first oil path and is supplied to the relief oil path by establishing communication between the second oil path, the intermediate oil path, and the relief oil path at the oil pressure control valve when oil pressure of the working oil in the first oil path is within a fourth pressure range which is greater than the third pressure range.

* * * * *